US006003881A

United States Patent [19]

Ellis et al.

[11] Patent Number: 6,003,881

[45] Date of Patent: Dec. 21, 1999

[54] VARIABLE TRAINING RESISTANCE DEVICE

[75] Inventors: Todd D. Ellis, Boston, Mass.; Peter Foley, Minnetonaka, Minn.; Lennert B. Johnson, Milford, N.H.; David J. Lacorazza, Norwell, Mass.

[73] Assignees: Reebok Interantional Ltd., Stoughton, Mass.; V2 Jenex, Milford, N.H.

[21] Appl. No.: 08/931,457

[22] Filed: Sep. 17, 1997

[51] Int. Cl.[6] ..... A63C 17/14

[52] U.S. Cl. ..... 280/11.2

[58] Field of Search ..... 288/11.222, 11.21; 188/5, 68, 25, 82.8, 82.84

[56] References Cited

U.S. PATENT DOCUMENTS

| | | | |
|---|---|---|---|
| 4,312,514 | 1/1982 | Horowitz et al. | 280/11.2 |
| 4,553,767 | 11/1985 | Robjent et al. | 280/11.21 |
| 5,192,099 | 3/1993 | Riutta | 280/11.2 |
| 5,253,884 | 10/1993 | Landers | 280/11.27 |
| 5,411,276 | 5/1995 | Moldenhauer | 280/11.2 |
| 5,413,362 | 5/1995 | DeSantis | 280/11.22 |
| 5,511,805 | 4/1996 | Mcgrath | 280/11.2 |
| 5,709,395 | 1/1998 | Lee | 280/11.21 |

*Primary Examiner*—Kevin Hurley
*Assistant Examiner*—Michael Britton
*Attorney, Agent, or Firm*—Sterne, Kessler Goldstein & Fox P.L.L.C.

[57] ABSTRACT

A variable training resistance device for an in-line skate. The skate includes a boot and a plurality of wheels disposed on a chassis. A resistance assembly, including a cam and bearing assembly or a rack and pinion assembly, is disposed between two of the wheels on the chassis. The cam and bearing assembly includes a plurality of cam carrier blocks disposed along either side of the chassis, wherein one of the cam carrier blocks has a first cam axle fixedly disposed thereon. A cam lever having a second cam axle is rotatably mounted on the chassis, and a plurality of cams are rotatably disposed on the first and second cam axles. Bearings are rotatably disposed between the cams and can be adjusted vertically to contact and provide resistance to the wheels of the in-line skate. The resistance assembly also includes a microadjust assembly to vary the position of the bearings with respect to the wheels of the skate. The rack and pinion assembly includes a rack, a pinion for engaging the rack, bearings disposed about the pinion, and a lever for moving the pinion upwardly or downwardly on the rack. The bearings can be moved downwardly to frictionally engage and provide resistance to the wheels of the in-line skate.

13 Claims, 10 Drawing Sheets

VARIABLE TRAINING RESISTANCE DEVICE

BACKGROUND OF THE INVENTION

1. Field of the Invention

The present invention relates to a variable training resistance device for providing rolling resistance to a wheeled vehicle. In particular, the present invention relates to an adjustable resistance device for varying the amount of resistance provided to the wheels of an in-line skate.

2. Related Art

As the popularity of in-line skating continues to grow, more and more people are using in-line skates for purposes other than purely recreational skating. Several different categories of skaters and skates have evolved. For example, there are aggressive skates, speed skates, hockey skates, and many levels of recreational and fitness skates. Those people familiar with in-line skating often transition from recreational skating to fitness skating as they become more experienced.

Many beginner skaters have difficulties learning to use in-line skates, because the wheels and bearings allow the skater to travel at relatively high speeds with very little effort. In particular, beginner skaters often find it difficult to slow or stop the skate. This may result in the beginner skater colliding with people, bicycles or cars that may come in his path. Advances in braking systems for in-line skates have attempted to address the problem of slowing or stopping a skate. However, until a beginner skater becomes comfortable using such a braking system, the potential for injury exists.

Many experienced fitness and speed skaters use their in-line skates for conditioning and endurance training. However, because the wheels and bearings of in-line skates offer virtually no resistance, skaters must travel at very high speeds to achieve a desired heart rate and muscular conditioning. Many skaters do not wish to travel at such high speeds for training. Further, it is often difficult to safely travel at high speeds when skating on a busy bicycle path or street.

Thus, what is needed is a system that will effectively apply a sufficient force to at least one wheel of a skate to provide resistance to the skate wheel. Further, what is needed is a training resistance device that is adjustable so that the skater can vary or adjust the positioning of the resistance member to accommodate a variety of different wheel sizes and to vary the amount of resistance to accommodate a particular exercise routine.

SUMMARY OF THE INVENTION

The variable training resistance device of the present invention provides a system that addresses many of the problems encountered by both beginner skaters and fitness and speed skaters. The beginner skater can use the variable training resistance device of the present invention as a safety device for easily negotiating steep, dangerous downhills and as a speed governor to help beginner skaters learn how to skate. Thus, the beginner skater can easily actuate the resistance device to slow the skate wheels, thereby allowing the beginner skater to become accustomed to skating before traveling at high speeds. The fitness skater can use the variable training resistance device as a training aid to provide increased resistance so that the skater can achieve an elevated heart rate and improved muscular conditioning without having to travel at high speeds.

The skate of the present invention includes a skate boot attached to a chassis. The chassis has a plurality of wheels disposed on its lower surface, and a variable training resistance device of the present invention mounted between the wheels.

The variable training resistance device can be configured to include a cam and bearing assembly and a microadjust assembly. The cam and bearing assembly includes cam carrier blocks designed to slide up and down within the chassis. Cams are attached to each of the cam carrier blocks, and bearings are disposed between the cams. A cam lever is attached to one side of the cam carrier block and is used to actuate the bearings to engage the wheels of the skate.

The microadjust assembly includes a spur gear drive having spur gears. The spur gears are positioned to mesh with each other and are disposed on common axles with adjuster dials. The axles are inserted into threaded holes in the cam carrier blocks.

In use, the skater rotates the cam lever 180° to engage the bearings with the wheels of the skate. The skater may also rotate the adjuster dials of the microadjust assembly to vertically adjust the position of the bearings with respect to the wheels. The skater can use the adjuster dials to alter the position of the bearings to accommodate varying wheel sizes and to increase or decrease the rolling resistance of the device to accommodate different training regimens.

The variable training resistance device can alternatively be configured to include a rack and pinion assembly. The rack and pinion assembly includes a rack disposed on either side of the chassis and a pinion disposed through the sidewalls of the chassis. The pinion has spline gears disposed thereon to engage the teeth of the rack. A lever is disposed on one end of the pinion and engages the teeth of the pinion so that the lever and pinion rotate together. A roller assembly, including bearings and a hardened steel tube, is disposed about the pinion between the sidewalls of the chassis. As the user rotates the lever, the pinion and the roller assembly move upwardly or downwardly with respect to the rack. As the roller is moved downwardly, the hardened steel tube of the roller assembly comes into contact with and frictionally engages a wheel or wheels of the in-line skate.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Further, although only one skate in a pair of skates is shown in the figures, the left and right skates are mirror images of each other, except that typically only one of the two skates has a brake attached thereto. While specific configurations and arrangements are discussed, it should be understood that this is done for illustrative purposes only. A person skilled in the relevant art will recognize that other configurations and arrangements can be used without departing from the spirit and scope of the invention.

Figure 1:
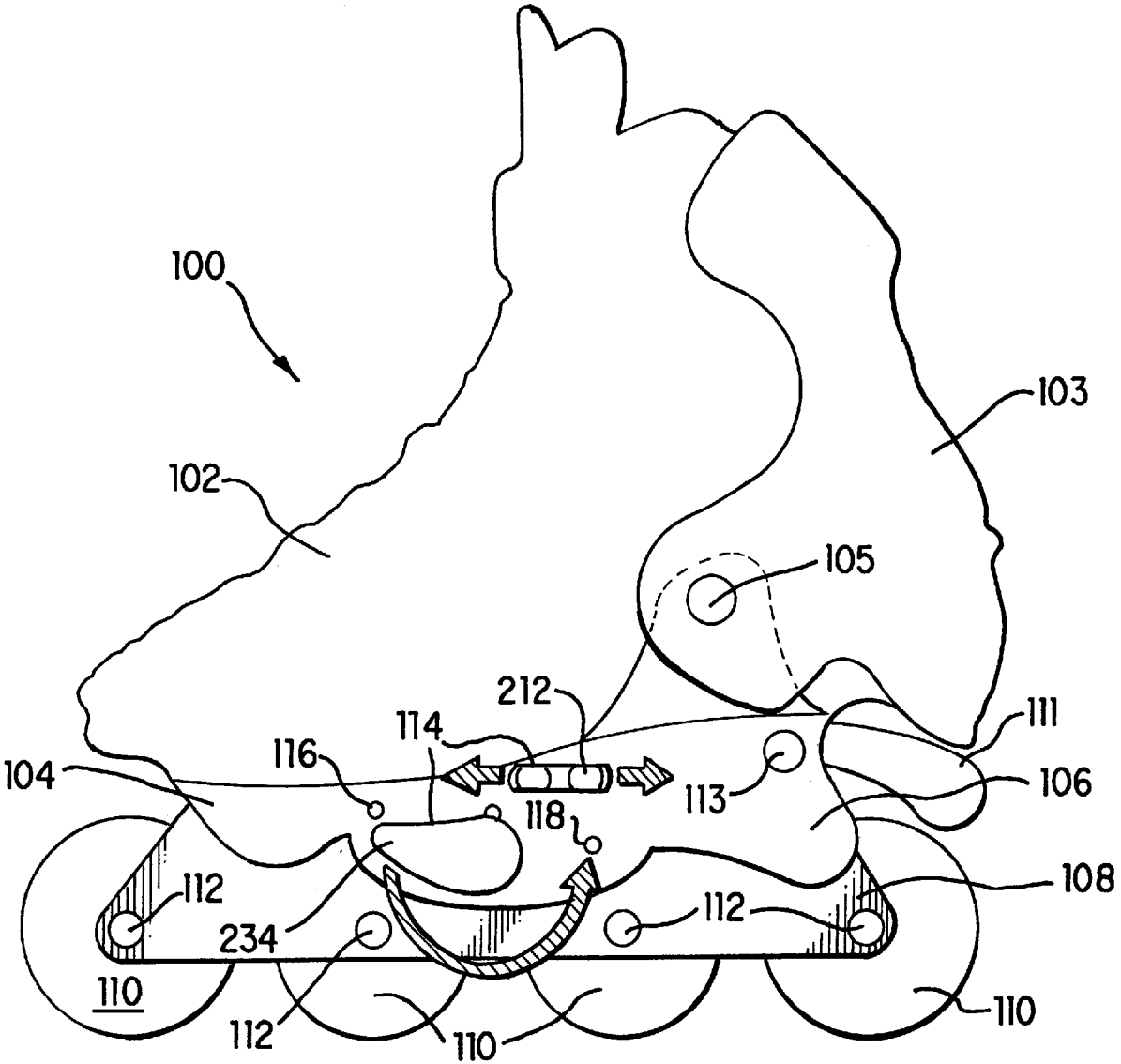
FIG. 1 shows a side view of a skate with a variable training resistance device of the present invention.

FIG. 1 shows an example of a skate 100 on which the variable training resistance device of the present invention may be used. However, it would be apparent to one skilled in the relevant art that the present invention could be adapted to be used on any type of skate or various other wheeled vehicles. Skate 100 includes a boot 102 and a chassis 104. Boot 102 may be made from a soft material, such as nylon or leather, or may be injection molded from a plastic material, or made using other processes apparent to one skilled in the relevant art. In one embodiment, boot 102 includes a cuff 103 rotatably mounted thereon about a pivot point 105.

In the example shown in FIG. 1, chassis 104 consists of a transition mount 106 and a frame 108. In one embodiment, frame 108 is made by pultrusion. Pultrusion is a process for making composite parts having a nearly constant cross-section on a continuous basis. In the pultrusion process, fibers, including fiber mats or cloths, are joined to form a fiber bundle which is soaked in a resin bath until it is completely wetted. Excess resin is then removed from the wetted fiber bundle, and the bundle is directed into a heated die. The part is then shaped and cured in the die. The die interior dimensions gradually reduce in size until the final shape is achieved. During this shaping, the part is cured by either thermally heating the die or by subjecting the material to radio frequency (rf) radiation. A puller system, either a series of part-shaped grippers or double continuous belts or caterpillar pullers, pull the part through the die. Part cut-off and packaging is completed after the puller. This process is described in further detail in an article by A. Brent Strong, Ph.D., entitled "Versatility in Pultrusion," *Composites Fabrication*, June, 1996, pp. 9–13, the disclosure of which is incorporated herein by reference.

Frame 108 may also be made using other processes, such as, injection molding, extrusion, machining, die-casting, and other techniques which would be apparent to one skilled in the relevant art. Transition mount 106 is used to accommodate frame 108 and to provide a raised footbed for the skater. In an alternate embodiment, transition mount 106 and frame 108 could be injection molded from a single piece of material to form a unitary chassis. Similarly, it would be apparent to one skilled in the relevant art to mold boot 102 and chassis 104 as a unitary member.

Boot 102 may be rigidly attached to transition mount 106 by gluing, screws, or by other fastening means apparent to one skilled in the relevant art. In one embodiment, transition mount 106 is made by injection molding. However, it would be apparent to one skilled in the relevant art that transition mount 106 could also be made by extrusion, die-casting, machining, or other known manufacturing techniques.

Frame 108 has a plurality of wheels 110 rotatably mounted thereon. Wheels 110 are rotatably mounted on axles 112, which are mounted on frame 108. In one embodiment, wheels 110 are conventional and may include a conventional bearing and spacer arrangement (not shown).

A brake 111 is rotatably mounted on transition mount 106 about a pivot point 113. Brake 111 is described in further detail in pending patent application Ser. No. 08/733,813, entitled "Braking System For An In-Line Skate", filed on Oct. 18, 1996, incorporated herein by reference. In another embodiment, brake 111 is a conventional rubber brake pad, which is rigidly mounted on the rear of chassis 104 for frictionally engaging the ground. Further, brake 111 could be any other conventional brake assembly.

FIG. 1 also shows a resistance assembly 114, which is disposed in chassis 104. Resistance assembly 114 includes an adjuster dial 212 and a cam lever 234, as visible from the exterior of chassis 104. Cam lever 234 can be rotated between a point 116 and a point 118 on chassis 104, as shown by the arrow near cam lever 234 in FIG. 1. When cam lever 234 is rotated to point 116, as it is shown in FIG. 1, the skate is in "cruise" mode, because resistance assembly 114 (described in further detail below) does not engage wheels 110. When cam lever 234 is rotated to point 118, the skate is in "training" mode, because resistance assembly 114 frictionally engages at least one of wheels 110 to slow wheel rotation. Adjuster dial 212 can be rotated in either direction, i.e., left or right, as shown by the arrows to either side of adjuster dial 212. Rotation of adjuster dial 212 varies the vertical position of resistance assembly 114 in small increments with respect to wheels 110 to accommodate various wheel sizes and to adjust the amount of friction against wheels 110.

Figure 2:
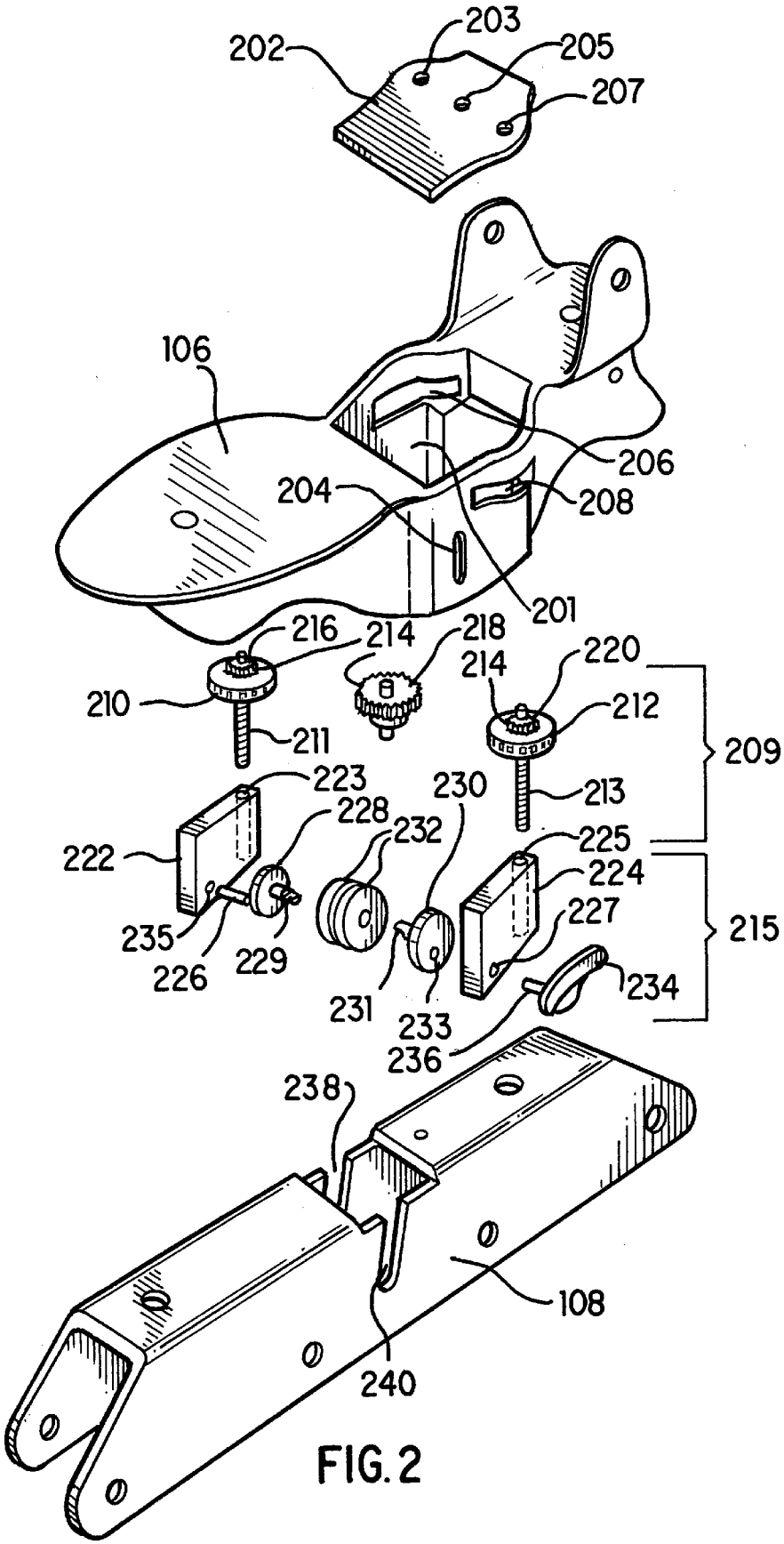
FIG. 2 shows an exploded view of the chassis and variable training resistance device of the present invention.
Figure 3:
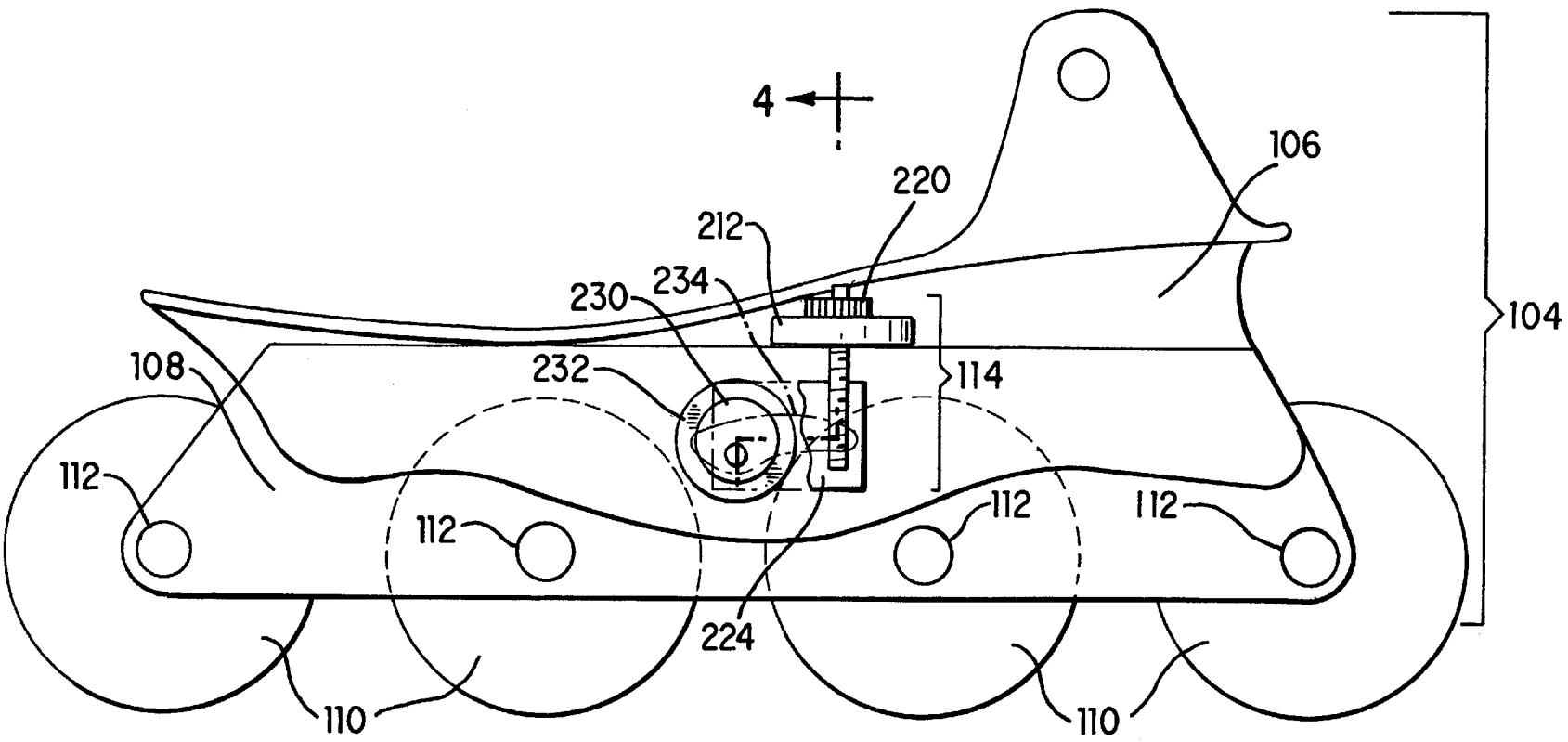
FIG. 3 shows a partial, side x-ray view of the chassis and variable training resistance device of the present invention.
Figure 4:
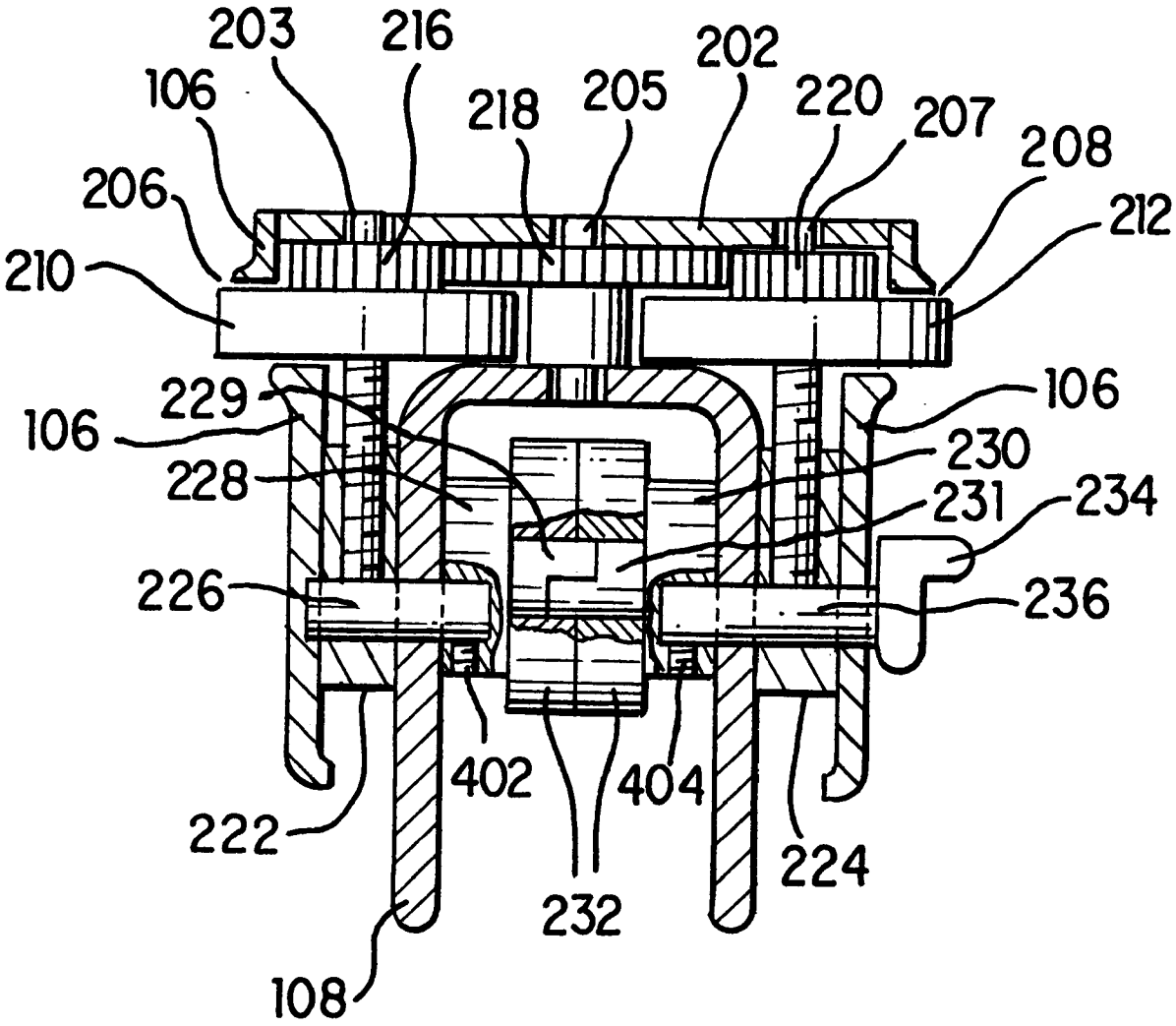
FIG. 4 shows a sectional view of the present invention as shown in FIG. 3, taken along a line 4—4.

Referring to FIGS. 2–4, resistance assembly 114 is shown in further detail as disposed in transition mount 106 and frame 108. Transition mount 106 includes an area 201 formed therein for receiving the components of resistance assembly 114. A cap 202 is fixedly disposed above area 201. Cap 202 includes holes 203, 205 and 207, discussed in further detail below.

Area 201 further includes a cam lever slot 204 and adjuster dial slots 206 and 208. Resistance assembly 114 includes a cam and bearing assembly 215 and a micro-adjust assembly 209.

Cam and bearing assembly 215 includes cam carrier blocks 222 and 224, cams 228 and 230, and bearings 232. In one embodiment, cam carrier blocks 222 and 224 are made from injection molded delrin. However, cam carrier blocks 222 and 224 could also be made from any other suitable material with similar properties. Cam carrier block 222 has a threaded hole 223 formed therein. A cam axle 226 is rotatably mounted in a hole 235 on one side of cam carrier block 222. Similarly, cam carrier block 224 has a threaded hole 225 formed therein and a hole 227 formed therethrough for receiving a cam axle 236.

In one embodiment, cams 228 and 230 are made from steel. However, cams 228 and 230 could also be made from any other material having similar properties, as would be apparent to one skilled in the relevant art. Cams 228 and 230 each have an axle with a notched end 229 and 231, and a hole 233 (not shown on cam 228) formed therein for receiving their respective cam axles 226 and 236.

Notched end 229 of the axle of cam 228 is formed to matingly engage with notched end 231 of the axle of cam 230. In an alternate embodiment, the ends of cams 228 and 230 have a square hole (not shown) formed therein. A square peg (not shown) is press fit into the square holes in each end of cams 228 and 230 to mechanically couple the cams. It would be apparent to one skilled in the relevant art that cams 228 and 230 could be assembled in other ways to provide the same mechanical coupling.

Bearings 232 have a hole formed therethrough for receiving ends 229 and 231 of the axles of cams 228 and 230 therein. In one embodiment, bearings 232 have an outer ring (not shown) made from chrome steel and a sleeve (not shown) covering the bearing made from 304 stainless steel. It would be apparent to one skilled in the relevant art, that other suitable materials could be used for the outer ring and sleeve. The effects of excessive wear on bearings 232 can be overcome by using bearings that are double contact sealed, at least 50% grease filled, and manufactured by precision ball bearing manufacturers.

In use, bearings 232 may encounter excessive heat build up which could potentially transfer to neighboring components. To avoid heat build up, the surrounding componentry should be made out of suitable materials that more readily dissipate heat and conduct heat away from the central hot spot around the bearings. Alternatively, venting holes (not shown) could be added to transition mount 106 and/or chassis 108 to allow greater air flow to bearings 232.

Cam and bearing assembly 215 further includes a cam lever 234 having cam axle 236 fixedly mounted on one side thereof. In one embodiment, cam lever 234 is made from aluminum. It would be apparent to one skilled in the relevant art that cam lever 234 could be made from any suitable material. Cam axle 236 is inserted through hole 227 of cam carrier block 224 and inserted into hole 233 of cam 230. Similarly, cam axle 226, disposed on one side of cam carrier block 222, is inserted into the hole (not shown) of cam 228. In an alternate embodiment, cam axles 226 and 236 are fixedly mounted on, or formed integrally with, cams 228 and 230, respectively. In this embodiment, cam lever 234 has a hole (not shown) formed therein to receive one end of cam axle 236. It would be apparent to one skilled in the relevant art that cam and bearing assembly 215 could be assembled in other ways to provide the same mechanical function.

When assembled, cam carrier blocks 222 and 224 are disposed within area 201 of transition mount 106 so that they may travel up and down on either side of the walls of transition mount 106. In one embodiment, cam lever 234 is rotated 180° between points 116 and 118 (shown in FIG. 1) to cause cams 228 and 230 to rotate, in turn, causing bearings 232 to travel up or down along an arc, toward or away from wheels 110. However, the present invention could be adapted so that a smaller or larger angle of rotation of cam lever 234 could be used to adjust the position of bearings 232. Frame 108 includes slots 238 and 240 for receiving therein cam axles 226 and 236, respectively.

Microadjust assembly 209 includes adjuster dials 210 and 212 and spur gear drive 214. In one embodiment, adjuster dials 210 and 212 are made from injection molded plastic. However, adjuster dials 210 and 212 could also be made from aluminum or other materials as would be apparent to one skilled in the relevant art. Adjuster dials 210 and 212 each have a threaded end 211 and 213, respectively, mounted thereon. Threaded end 211 is inserted into threaded hole 223 of cam carrier block 222. Similarly, threaded end 213 is inserted into threaded hole 225 of cam carrier block 224.

Spur gear drive 214 includes spur gears 216, 218 and 220. In one embodiment, spur gears 216, 218 and 220 are each made from injection molded plastic. Spur gear 216 is fixedly mounted on a common axis with adjuster dial 210. Spur gear 220 is also fixedly mounted on a common axis with adjuster dial 212. Spur gear 218 is disposed between spur gears 216 and 220. The teeth of the three gears mesh with each other so that rotation of one spur gear causes corresponding rotation of the other spur gears.

To microadjust the vertical position of bearings 232 with respect to wheels 110, the user rotates either adjuster dial 210 or 212. Rotation of one of these adjuster dials 210 or 212 is translated to the other adjuster dial via spur gear drive 214. Similarly, rotation of the adjuster dials 210 and 212 are translated via threaded ends 211 and 213 to cam carrier blocks 222 and 224. Thus, rotation of the adjuster dials 210 and 212 causes a micro adjustment of the vertical position of cam carrier blocks 222 and 224 within area 201 of transition mount 106, thereby causing an adjustment in the vertical position of bearings 232 in relation to wheels 110.

As shown in FIG. 3, bearings 232 may be disposed between the center two wheels 110 of skate 100. In use, the skater rotates cam lever 234 to point 118 to move bearings 232 into their fully-extended downward position so that they frictionally engage center wheels 110. In an alternate embodiment, the present invention could be disposed on chassis 104 such that bearings 232 contact only one of wheels 110 of skate 100.

Microadjust assembly 209 can be used to adjust the vertical position of bearings 232 to accommodate different wheel sizes. To avoid any resistance when skating, the skater can rotate cam lever 234 180° in the opposite direction to point 116 (as shown in FIG. 1) to move bearings 232 into their fully-extended upward position so that bearings 232 do not frictionally engage wheels 110. To alleviate any problems with excessive wheel wear due to engagement with the bearings 232, wheels constructed using a long-wearing material can be used.

As shown in FIG. 4, cam axles 226 and 236 are fixedly disposed within holes in cams 228 and 230 by set screws 402 and 404, respectively. As can be further seen in FIG. 4, holes 203, 205 and 207 of cap 202 are positioned so that the top of spur gears 216, 218 and 220, respectively, can fit therethrough. Adjuster dials 210 and 212 also extend through area 201 of transition mount 106 at adjuster dial slots 206 and 208, respectively.

A typical problem with in-line skates is that through use, dirt and sand contaminate the components of the skate. One solution is to design the skate so that it is self-cleaning, having several open areas (not shown) in transition mount 106 and frame 108 to allow dirt and sand to easily fall out on its own. Further, the system should be designed so that it can be easily disassembled, cleaned and reassembled by the user.

Figure 5:
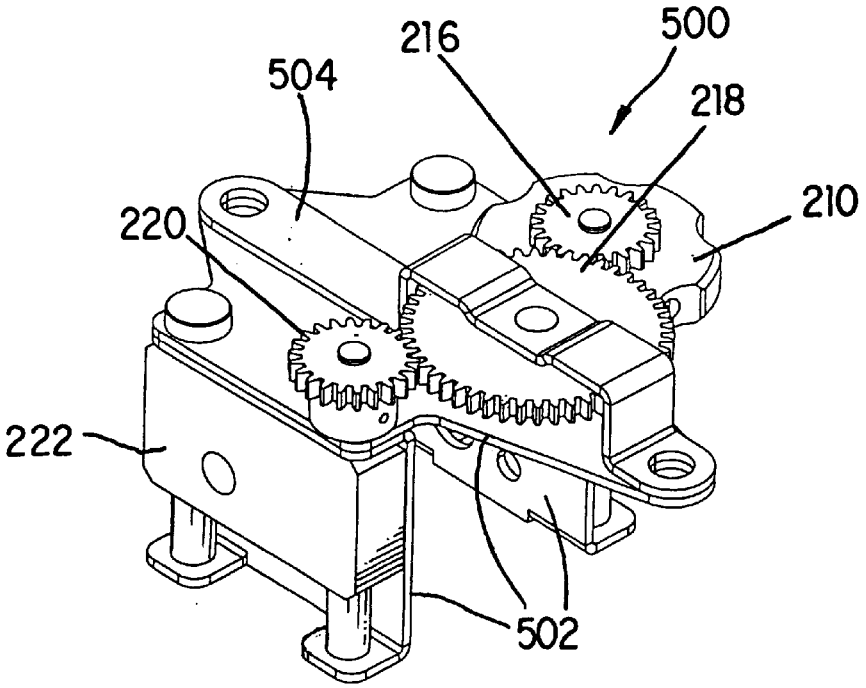
FIG. 5 shows a top, perspective view of a second embodiment of the variable training resistance device of the present invention.
Figure 6:
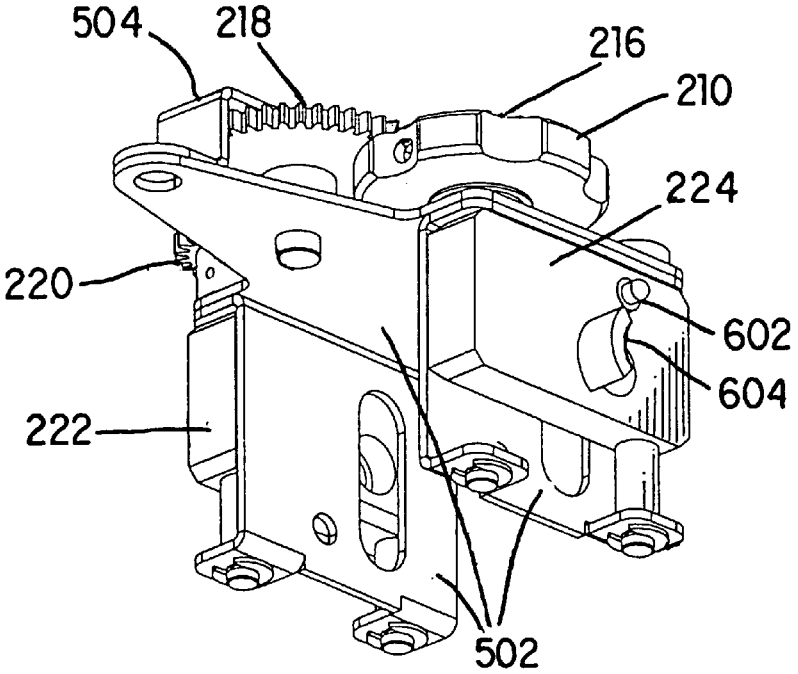
FIG. 6 shows a bottom, perspective view of the second embodiment of the variable training resistance device shown in FIG. 5.
Figure 7:
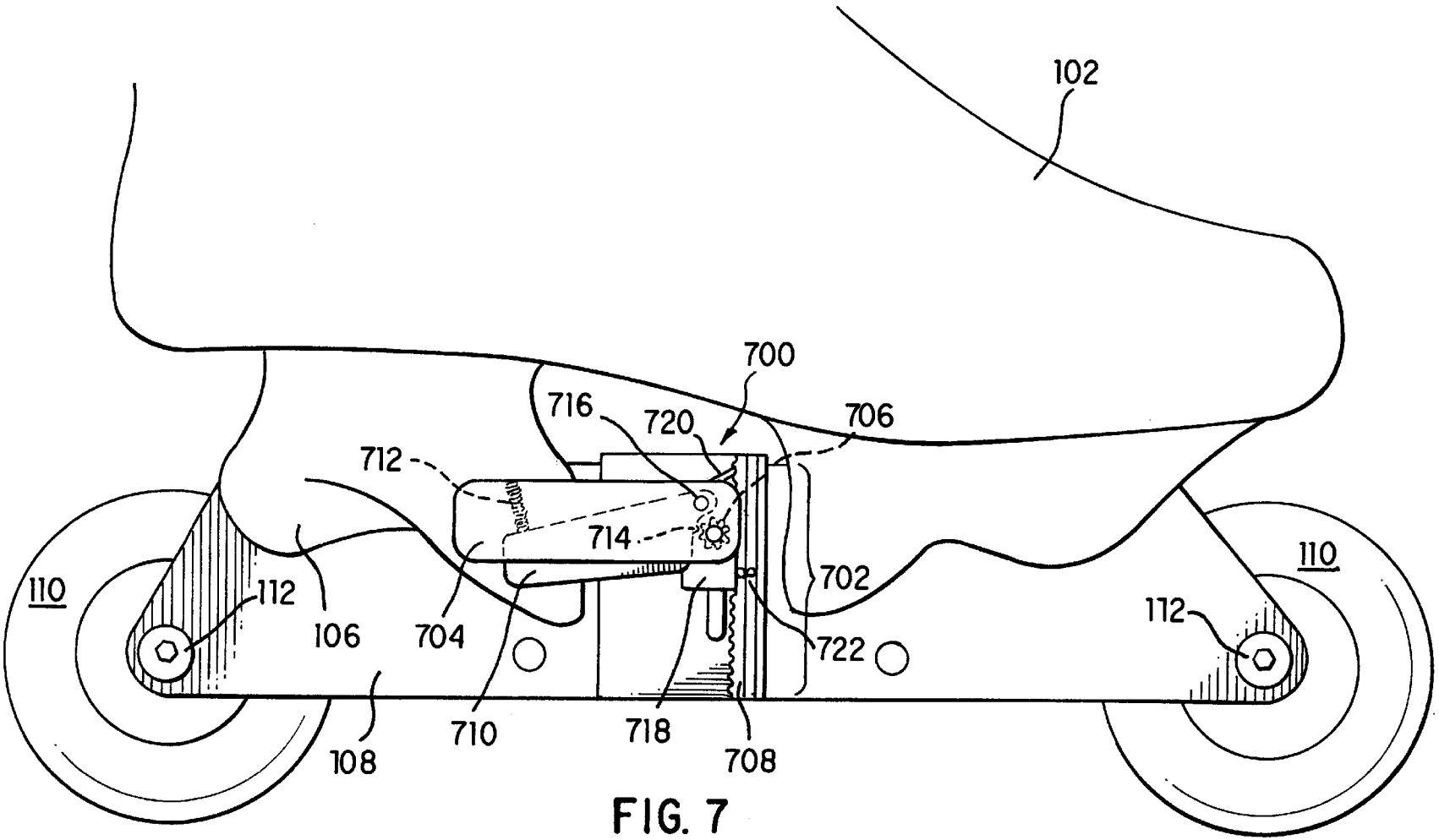
FIG. 7 shows a side view of a third embodiment of a variable training resistance device of the present invention disposed on a skate, and including a rack and pinion assembly.

FIGS. 5 and 6 show a second embodiment of a variable training resistance device 500 of the present invention. Device 500 includes a bracket 502 and a idler gear bracket 504, referred to collectively as a cassette assembly. The components of device 500, including cam and bearing assembly 215 and microadjust assembly 209 (as shown in FIG. 2), are mounted on the cassette assembly. This cassette assembly serves as a way of creating a unified, sub-assembled, self-contained unit, containing the necessary components of the device. The cassette assembly aids in the assembly, maintenance and functioning of device 500. The cassette assembly is fastened to the top of chassis 108 by means of a bolt and nut, or rivets, through the holes shown in FIGS. 5 and 6.

Variable training resistance device 500 further includes a plunger 602 and cam lever stop 604 which are mounted on cam carrier block 224 directly behind cam lever 234 (not shown in FIGS. 5 and 6). Plunger 602 and cam lever stop 604 provide an indication to the user that the roller is in its fully-raised or fully-lowered position.

Cam lever stop 604 prevents the user from rotating cam lever 234 more than 180° in either direction. In particular, the sides of cam lever 234 come into contact with cam lever stop 604 once cam lever 234 has been fully rotated clockwise or counterclockwise.

Plunger 602 is spring-loaded so that it moves in and out of cam carrier block 224. Two holes (not shown) are formed on the back side of cam lever 234. When cam lever 234 is rotated fully clockwise, a first one of the holes on cam lever 234 aligns with plunger 602, so that plunger 602 pops out of cam carrier block 224 and into the first hole on the back of cam lever 234 to click into place. This clicking of plunger 602 into the back of cam lever 234 provides an indication to the user that variable training resistance device 500 is locked into a first position.

When the user begins to rotate cam lever 234 counterclockwise, plunger 602 returns back into cam carrier block 224. When cam lever 234 is rotated fully counterclockwise, the second hole on cam lever 234 aligns with plunger 602, so that plunger 602 pops out of cam carrier block 224 and into the second hole on the back of cam lever 234 to click into place. This clicking of plunger 602 into the back of cam lever 234 provides an indication to the user that variable training resistance device 500 is locked into a second position.

In the embodiment shown herein, a plunger 602 is used to engage the holes of the back of cam lever 234. However, it would be apparent to one skilled into the relevant art that other similar mechanisms, such as a spring-loaded ball, could also be used to engage the holes on the back of cam lever 234.

FIGS. 7–10 show a third embodiment of a variable training resistance device 700 of the present invention. Variable training resistance device 700 includes a rack and pinion assembly 702. Rack and pinion assembly 702 includes a lever 704 and a pinion 706, which includes a spline gear formed thereon, and a rack 708. In this embodiment, rack and pinion assembly 702 is shown disposed on frame 108 between two wheels (not shown) of an in-line skate. However, it would be apparent to one skilled in the relevant art that rack and pinion assembly 702 could also be positioned to engage only one of the wheels of an in-line skate.

As shown in FIGS. 7 and 9A–9C, lever 704 includes a trigger 710 and a spring 712. Trigger 710 includes a tooth 714 disposed thereon to engage the teeth of the spline gear of pinion 706. Trigger 710 is configured to pivot about a pivot pin 716 independent of lever 704. Lever 704 is rotatingly engaged with pinion 706, so that rotation of lever 704 causes corresponding rotation of pinion 706. Rack and pinion assembly 702 further includes a follower 718. Follower 718 includes a stem 720 that is configured to engage the teeth on rack 708. Follower 718 rotates freely about pinion 706 and includes a spring plunger 722 to bias stem 720 against rack 708 to lock rack and pinion assembly 702 in position.

Figure 8A:
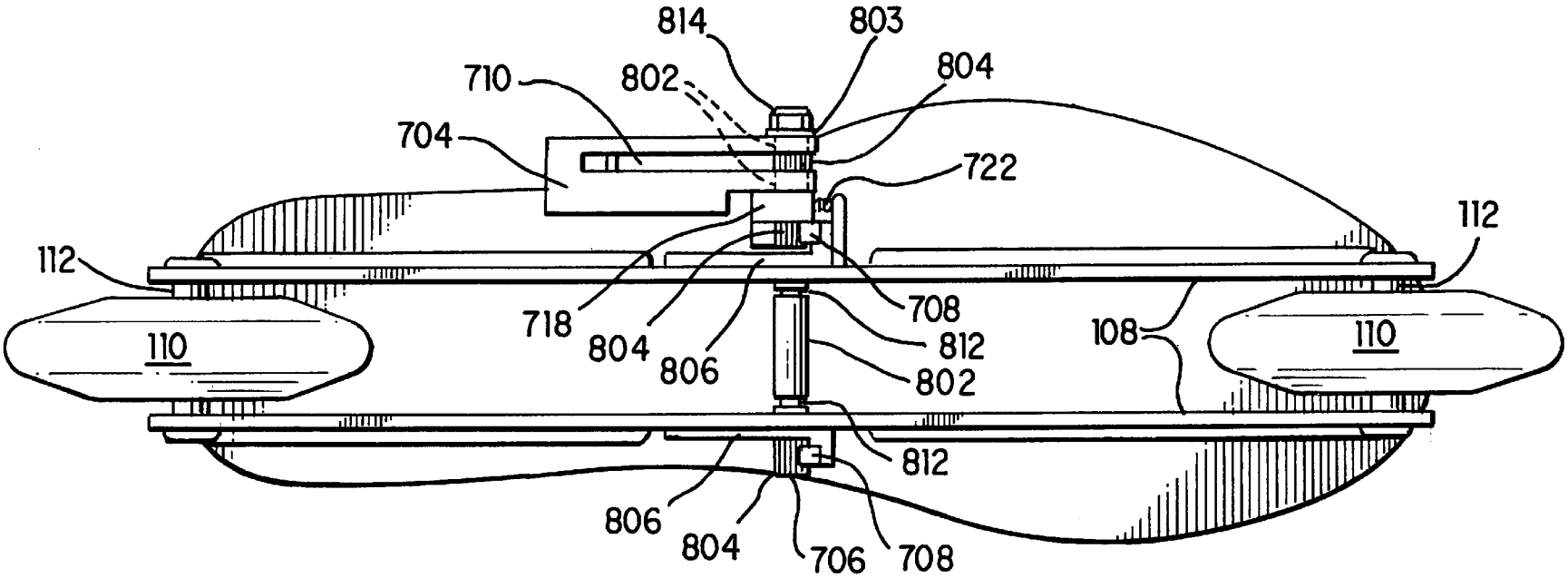
FIGS. 8A and 8B show a bottom, plan view of the present invention shown in FIG. 7.
Figure 8B:
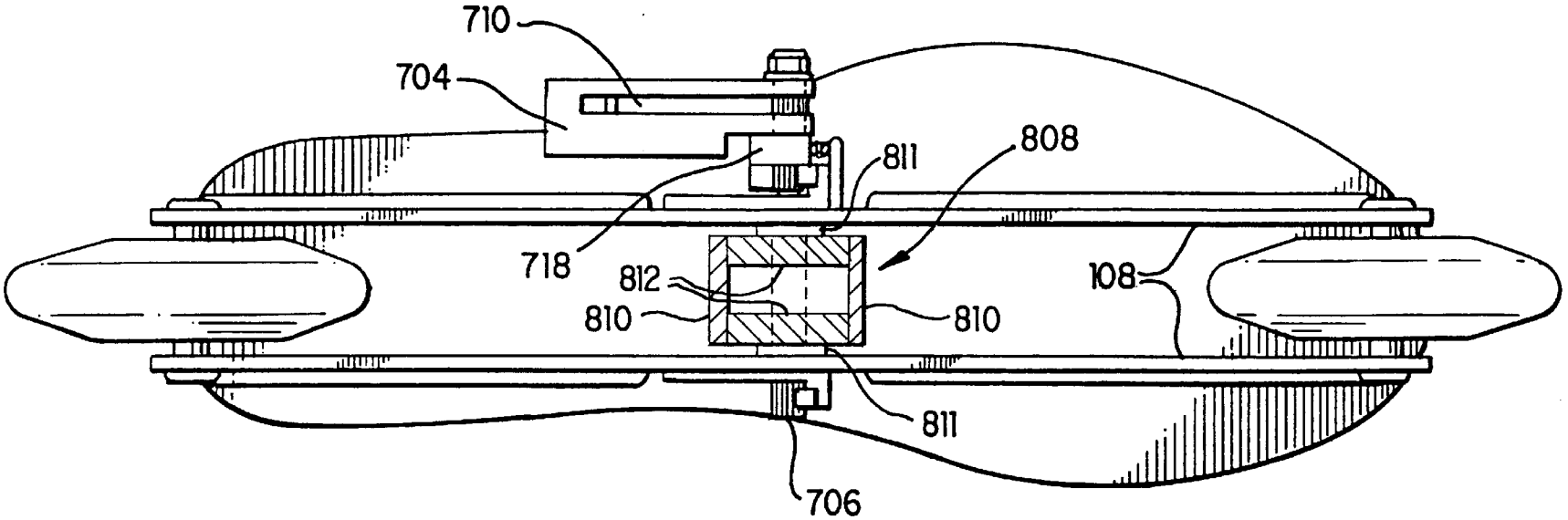

The assembly of training resistance device 700 is shown in detail in FIGS. 8A and 8B. Frame 108 of an in-line skate is made of a composite material. Slots (not shown) are formed in frame 108 for receiving pinion 706 therethrough, such that pinion 706 can freely move up and down within the slots. In one embodiment, pinion 706 is formed from an 8 mm steel rod having 8 mm spline gears on both ends thereof and a 5 mm thread (not shown) on one end 803. A roller assembly 808, as shown in FIG. 8B, is disposed about a central portion of pinion 706 between sidewalls of frame 108. Roller assembly 808 is moved up and down by the movement of pinion 706 of rack and pinion assembly 702, as described in detail below.

Roller assembly 808 includes a hardened steel tube 810 about a periphery thereof and bearings 812 on either side thereof. In one embodiment, roller assembly 808 is identical to bearings 232, as described above with respect to FIG. 2. In an alternate embodiment, kinematic damping can be added to roller assembly 808, as described in U.S. Pat. No. 4,898,403, which is incorporated herein by reference.

Pinion 706 is disposed through the slot formed in frame 108. Mounting brackets 806 are disposed on the outside of frame 108 to provide support for device 700 and for mounting rack 708 thereon. Pinion 706, includes smooth portions 802 and spline gear portions 804. Follower 718, mounting brackets 806, and roller assembly 808 are disposed about smooth portions 802 of pinion 706, so that these portions can rotate freely about pinion 706. Lever 704 is disposed about pinion 706 so that it rotatingly engages pinion 706. When lever 704 is rotated, a corresponding rotation of pinion 706 occurs. Lever 704 is fastened onto pinion 706 laterally with a nut 814. Retaining rings 811 are fastened on either side of roller assembly 808 and fit into grooves 812 formed in pinion 706 to prevent pinion 706 from sliding out of the slots in frame 108.

In this embodiment, rack 708 is fastened on the outside of frame 108. The spline gears of pinion 706 mesh with the notches on each rack 708, so that when lever 704 is rotated, pinion 706 moves up or down relative to each rack 708. The movement of pinion 706 causes roller assembly 808 to also move up or down relative to frame 806, such that roller assembly 808 frictionally engages the wheels of the in-line skate. In the embodiment described above, in which the spine gear is 8 mm and the lever is approximately 2 inches, the force ratio between the spline gear and lever 704 is approximately 13:1. In an alternate embodiment having a 6 mm spline gear, the force ratio is approximately 16:1. When the user moves lever 704 approximately 90 degrees, roller assembly 808 moves upwardly or downwardly, depending on the direction of rotation of lever 704, approximately 6 mm with an 8 mm spline gear and approximately 4.6 mm with a 6 mm spline gear. For smaller adjustments to the vertical position of roller assembly 808, lever 704 can be moved up or down a few clicks, i.e., teeth, on rack 708, until an adequate adjustment of the frictional engagement of roller assembly 808 against the wheels of the in-line skate is achieved.

Figure 9A:
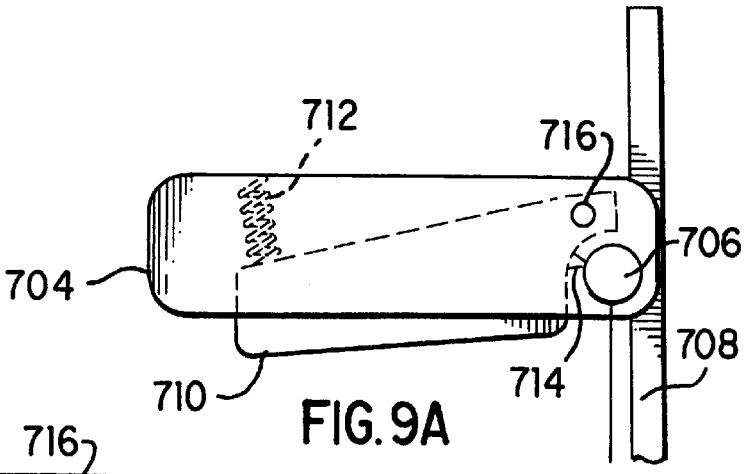
FIGS. 9A–9C show side views of three positions of a lever of the rack and pinion assembly of the present invention shown in FIG. 7.
Figure 9B:
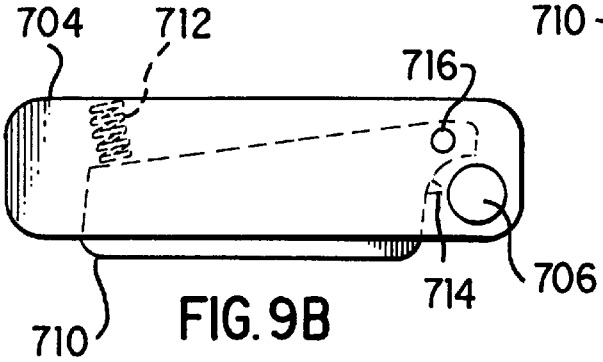
Figure 9C:
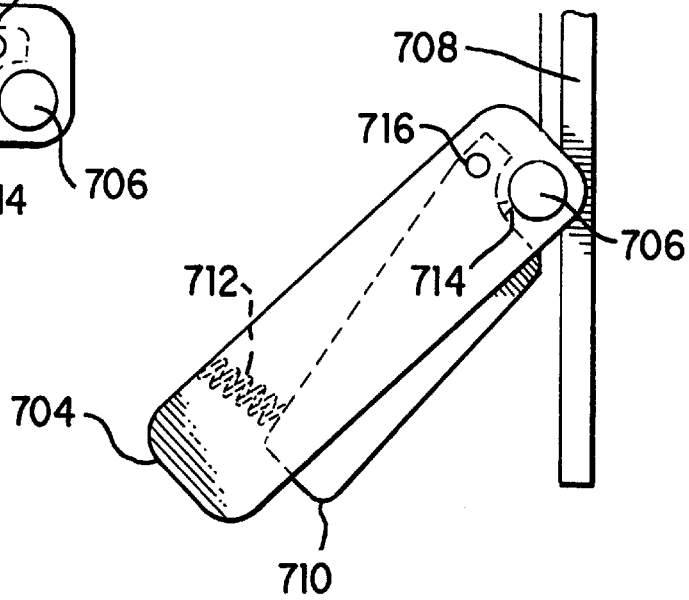
Figure 10:
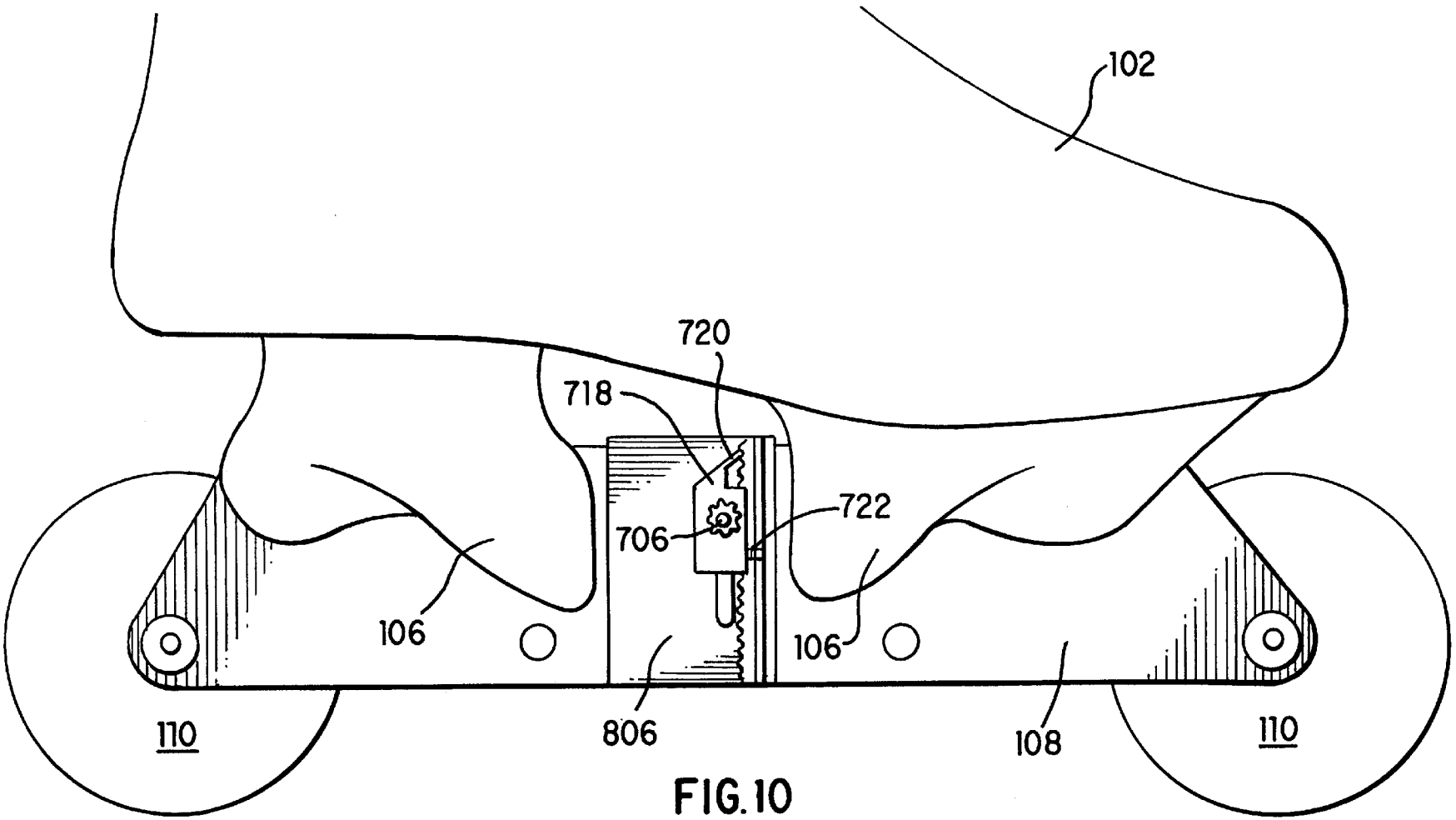
FIG. 10 shows a side view of a portion of the third embodiment of the present invention.

FIGS. 9A–9C show three positions of lever 704 during use. Follower 718 is not shown in these Figures, however, a detailed view of follower 718, without lever 704 is shown in FIG. 10. FIG. 9A shows lever 704 locked in place on rack 708 in a horizontal position. FIG. 9B shows lever 704 in an unlocked position, and FIG. 9C shows lever 704 locked in place on rack 708 in a downwardly slanting position.

When the user presses trigger 710, spring 712 is compressed and trigger 710 pivots about pivot pin 716, independently of lever 704. This pivoting movement allows tooth 714 to disengage the teeth of spline gear portion 804 of pinion 706, as shown in FIG. 9B. When tooth 714 is disengaged from pinion 706, pinion 706 is free to be rotated up and down rack 708. To rotate pinion 706 down rack 708, the user rotates lever 704 downwardly, as shown in FIG. 9C. As described above, lever 704 and pinion 706 are rotatingly engaged such that rotation of one causes rotation of the other. Follower 718, as shown in FIG. 10, follows pinion 706 down rack 708, and spring 722 biases stem 720 of follower 718 so that it engages each tooth of rack 708 during movement up or down rack 708. Thus, stem 720 provides a clicking sound as it moves into position between the teeth on rack 708 such that the user can hear and feel the movement of roller assembly 808. This allows the user to adjust the position of roller assembly 808 with respect to wheels 110 of the skate tooth-by-tooth on rack 708.

When the user releases trigger 710, spring 712 forces trigger 710 to pivot about pivot pin 716 to its fully extended position, such that tooth 714 fixedly engages the teeth of spline gear portion 804 of pinion 706. When lever 704 is rotated downwardly such that roller assembly 808 substantially engages wheels 110, the pressure of wheels 110 against roller assembly 808 will force rack and pinion assembly 702 upwardly when trigger 710 is depressed. Further, downward rotation of lever 704 causes lever 704 to contact the side of follower 718 such that lever 704 causes rotation of follower 718 about pinion 706. This rotation causes stem 720 to disengage from rack 708, thereby allowing pinion 706 to freely rotate and travel up rack 708.

Rack and pinion assembly 702 of the present invention is configured so that it can be used with any size wheel. In particular, the present invention can be used to accommodate wheels between 72 mm and 80 mm in diameter. In a further embodiment, a transparent window is included in frame 108, so that the user can see the movement of roller assembly 808 relative to the wheels.

The invention has been described using an example of an in-line skate. However, the variable training resistance device of the present invention could also be used on any human-powered, wheeled vehicle, such as a skateboard, roller skis, or roller skates, to provide a rolling resistance.

While the invention has been particularly shown and described with reference to preferred embodiments thereof, it will be understood by those skilled in the art that various changes in form and details may be made therein without departing from the spirit and scope of the invention.

What is claimed is:

1. An in-line skate, comprising:

a boot;

a chassis having an upper surface and a lower surface, wherein said boot is disposed about said upper surface of said chassis;

a plurality of wheels disposed on said lower surface of said chassis;

a resistance assembly disposed on said chassis and having a cam and bearing assembly which is adjustable vertically between a first position in which the bearing assembly frictionally engages at least one of said plurality of wheels to provide resistance and a second position in which the bearing assembly disengages said at least one wheel; and a microadjust assembly disposed on said resistance assembly for further adjusting the vertical position of said cam and bearing assembly from said first and second positions, with respect to said plurality of wheels.

2. The in-line skate of claim 1, wherein said chassis comprises a transition mount and a frame.

3. The in-line skate of claim 1, wherein said cam and bearing assembly comprises:

a plurality of cam carrier blocks disposed along either side of said chassis, one of said cam carrier blocks having a first cam axle rotatably disposed thereon;

a cam lever having a second cam axle, wherein said second cam axle is rotatably disposed in the other of said cam carrier blocks;

a plurality of cams rotatably disposed on said first and second cam axles; and a plurality of bearings rotably disposed between said cams.

4. The in-line skate of claim 3 wherein said other of said cam carrier blocks has a cam lever stop disposed thereon.

5. The in-line skate of claim 3, wherein said other of said cam carrier blocks has a spring-loaded mechanism attached thereon for engaging a hole formed on one side of said cam lever.

6. The in-line skate of claim 3, wherein each of said cams have an axle having a notched end, wherein said notched ends matingly engage each other.

7. The in-line skate of claim 3, wherein said microadjust assembly comprises an adjuster dial having a threaded end and wherein one of said cam carrier blocks has a threaded hole formed therein to receive said threaded end of said adjuster dial, such that rotation of said adjuster dial causes said cam carrier block to translate up or down within said chassis.

8. The in-line skate of claim 1, wherein said microadjust assembly further comprises:

a plurality of adjuster dials, each adjuster dial having a threaded end;

a spur gear drive located between said adjuster dials, said spur gear drive having a plurality of spur gears, wherein one of said spur gears is fixedly mounted to each of said adjuster dials, and wherein said cam carrier blocks each have a threaded hole formed therein to receive said threaded end of each of said adjuster dials, such that rotation of one of said adjuster dials causes said other adjuster dial to rotate via said spur gear drive and rotation of said adjuster dial causes said cam carrier blocks to translate up or down within said chassis.

9. A variable training resistance device for use on an in-line skate, comprising:

a cam and bearing assembly which can be adjusted vertically between a first position to frictionally engage at least one of a plurality of wheels and a second position to disengage said at least one wheel of the in-line skate; and a microadjust assembly disposed on the in-line skate and matingly engaging said cam and bearing assembly for adjusting the position of said cam and bearing assembly with respect to said plurality of wheels.

10. The device of claim 9, wherein said cam and bearing assembly comprises:

a plurality of cam carrier blocks disposed along either side of a chassis of the in-line skate, one of said cam carrier blocks having a first cam axle rotatably disposed thereon;

a cam lever having a second cam axle, wherein said cam lever is rotatably mounted on said chassis;

a plurality of cams rotatably disposed on said first and second cam axles; and a plurality of bearings rotatably disposed between said cams.

11. The device of claim 10, wherein each of said cams have an axle having a notched end, wherein said notched ends matingly engage each other.

12. The device of claim 10, wherein said microadjust assembly comprises an adjuster dial having a threaded end and wherein one of said cam carrier blocks has a threaded hole formed therein to receive said threaded end of said adjuster dial, such that rotation of said adjuster dial causes said cam carrier block to translate up or down within said chassis.

13. The device of claim 10, wherein said microadjust assembly further comprises:

a plurality of adjuster dials, each adjuster dial having a threaded end;

a spur gear drive disposed between said adjuster dials, said spur gear drive having a plurality of spur gears, wherein one of said spur gears is fixedly mounted to each of said adjuster dials, and wherein said cam carrier blocks each have a threaded hole formed therein to receive said threaded end of each of said adjuster dials, such that rotation of one of said adjuster dials causes said other adjuster dial to rotate via said spur gear drive and rotation of said adjuster dial causes said cam carrier blocks to translate up or down within said chassis.

* * * * *

UNITED STATES PATENT AND TRADEMARK OFFICE

CERTIFICATE OF CORRECTION

PATENT NO. : 6,003,881

DATED : December 21, 1999

INVENTORS : Ellis *et al.*

It is certified that an error appears in the above-identified patent and that said Letters Patent is hereby corrected as shown below.

In the Claims

Column 10, claim 3, line 14, please delete "rotably" and insert --rotatably-- therefor.

Signed and Sealed this

Fifth Day of December, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT : 6,003,881

DATED : December 21, 1999

INVENTOR(S) : Ellis *et al.*

It is certified that error appears in the above-identified patent and that said Letters Patent is hereby corrected as shown below:

Inventors section

Line 2, please delete "Lennert" and insert -- Lennart -- therefor.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*